US005687645A

United States Patent [19]

Kato

[11] Patent Number: 5,687,645

[45] Date of Patent: Nov. 18, 1997

[54] MECHANICAL PRESSING MACHINE

[75] Inventor: Heizaburo Kato, Shizuoka-ken, Japan

[73] Assignee: Sankyo Seisakusho Co., Tokyo, Japan

[21] Appl. No.: 660,791

[22] Filed: Jun. 6, 1996

[30] Foreign Application Priority Data

Jun. 19, 1995 [JP] Japan ..... 7-151342
Oct. 30, 1995 [JP] Japan ..... 7-281910

[51] Int. Cl.[6] ..... B30B 1/26

[52] U.S. Cl. ..... 100/282; 100/286; 100/292; 83/615; 83/628; 72/452.6

[58] Field of Search ..... 100/257, 282, 100/285, 286, 292; 83/615, 628; 72/451, 452.6

[56] References Cited

U.S. PATENT DOCUMENTS

| | | | |
|---|---|---|---|
| 2,532,320 | 12/1950 | Maussnest | 100/282 |
| 2,857,157 | 10/1958 | Bonquet | 83/615 |
| 3,859,838 | 1/1975 | Karsnak | 100/292 |
| 4,638,731 | 1/1987 | Kato | 100/292 |
| 4,699,036 | 10/1987 | Henne | 83/615 |
| 4,852,382 | 8/1989 | Gietz et al. | 100/286 |
| 4,967,586 | 11/1990 | Hecht | 100/292 |
| 5,467,706 | 11/1995 | Kato . | |
| 5,605,096 | 2/1997 | Kato | 100/292 |

FOREIGN PATENT DOCUMENTS

K16179 11/1955 Germany ..... 100/286

OTHER PUBLICATIONS

U.S. application No. 08/610,452, Kato, filed Mar. 4, 1996.

*Primary Examiner*—Stephen F. Gerrity
*Attorney, Agent, or Firm*—Harness, Dickey & Pierce, P.L.C.

[57] ABSTRACT

There is disclosed a mechanical pressing machine in which an unbalanced inertia force, produced during reciprocal movement of a slider, is canceled without producing deflection in the whole of the pressing machine, thereby enhancing dynamic precision. The slider, slidably mounted at a lower portion of a frame, is connected to a dynamic balancer, slidably mounted at an upper portion of the frame, by link mechanisms. A press cam, having a cam surface in contact with cam followers mounted respectively on the slider and the dynamic balancer, is fixedly mounted on a cam shaft. Dynamic balancer cams, each having a cam surface in contact with cam followers mounted respectively on interconnecting points of the link mechanisms, is fixedly mounted on the cam shaft. The dynamic balancer is driven to move in a direction opposite to a direction of movement of the slider, so that an unbalanced inertia force, produced in the moving slider, is canceled by an oppositely-directed inertia force produced in the dynamic balancer.

8 Claims, 10 Drawing Sheets

MECHANICAL PRESSING MACHINE

BACKGROUND OF THE INVENTION

This invention relates generally to a mechanical pressing machine, and more particularly to a mechanical pressing machine provided with a dynamic balancing device for balancing an unbalanced inertia force in a reciprocating mechanism employing a plate cam.

One example of known mechanical presses employing a plate cam is of the constrained cam type using a yoke mechanism or the like. In such a mechanical press, a reciprocating member is connected to a follower portion through a connecting rod, and rotational movement of the plate cam is converted into reciprocal movement. When the press, employing such a plate cam, is operated, there develop vibrations due to an unbalanced inertia force produced by the reciprocal movement of a slider as in a conventional crank press, so that noises and a positional error are produced. To avoid these, a dynamic balancing device has usually been used in the press.

In the conventional dynamic balancing device, an unbalanced inertia force of the reciprocating slider is canceled by a balance weight (which is equivalent in weight to the slider) supported through a cam or a link at a position in opposite phase with a convex portion of the plate cam. With this construction, the unbalanced inertia force for the whole of the press is canceled by the balance weight, and vibrations of the press itself (except the slider and other moving parts) are reduced, so that the press can be operated at high speed.

In the above conventional pressing machine, however, when attention is directed to the slider on which an upper die is mounted, the inertia force F, generated during the reciprocal movement, produces deflection S ($S=F\times K$) in accordance with rigidity (spring constant) K of a load propagation path (usually from the follower to a press frame through the driver). Generally, this deflection S becomes the largest near to a lower dead center, so that the dimension of the slider is elongated downwardly, thereby adversely affecting the precision at the lower dead center. This deflection S is proportional to the inertia force, and therefore increases with the increase of the speed. Thus, although the pressing machine is made apparently quiet by the provision of the dynamic balancing device, the evaluation of the dynamic precision (for example, from the viewpoints of the lower dead center precision, a coining precision and so on) has not been satisfactory.

To overcome these problems, Applicant of the present application has earlier proposed mechanical pressing machines provided with a dynamic balancing device of high dynamic precision in Co-pending U.S. patent application Ser. Nos. 08/293,752 and 08/293,815.

SUMMARY OF THE INVENTION

It is an object of this invention to provide a mechanical pressing machine which is simpler in construction, and can achieve higher precision than the above earlier-proposed mechanical pressing machines.

According to the present invention, there is provided a mechanical pressing machine comprising:

- a slider supported on a lower portion of a frame for sliding movement in a vertical direction, the slider carrying an upper press die at its lower surface;
- a dynamic balancer supported on an upper portion of the frame for sliding movement in the vertical direction, the dynamic balancer being equal in weight to the slider;

- a cam shaft rotatably supported on the frame, and extending in a horizontal direction, the cam shaft being connected at one end thereof to rotation transmission means;
- at least one press cam fixedly mounted on the cam shaft for rotation therewith, the press cam having a cam surface in contact with cam followers mounted respectively on an upper surface of the slider and a lower surface of the dynamic balancer;
- at least one pair of link mechanisms provided on opposite sides of the press cam, respectively, each of the link mechanisms comprising a pair of first and second links of the same length which are pivotally connected at one ends thereof to the upper surface of the slider and the lower surface of the dynamic balancer, respectively, and are pivotally connected together at the other ends thereof; and
- at least one dynamic balancer cam fixedly mounted on the cam shaft for rotation therewith, the dynamic balancer cam having a cam surface in contact with cam followers each of which is mounted on the interconnected other ends of the first and second links of a respective one of the link mechanisms.

The one ends of the first and second links of the link mechanism can be pivotally connected respectively in coaxial relation to the cam followers mounted respectively on the upper surface of the slider and the lower surface of the dynamic balancer.

Therefore, in the present invention, by providing the dynamic balancer which moves in a direction opposite to the direction of movement of the slider when the slider moves, an unbalanced inertia force, produced during the reciprocal movement of the slider, is canceled, and deflection of the whole of the pressing machine is reduced, thereby enhancing the dynamic precision, and vibrations and noises are reduced. And besides, the pressing machines of the invention are simpler in construction, and achieve higher precision as compared with the above earlier-proposed pressing machines, and the slider and the dynamic balancer are moved simultaneously not by sliding contact but by rolling contact between the cams and the cam followers, and therefore the transmission efficiency is enhanced, and the high-speed operation can be suitably carried out.

DESCRIPTION OF THE PREFERRED EMBODIMENTS

Figure 1:
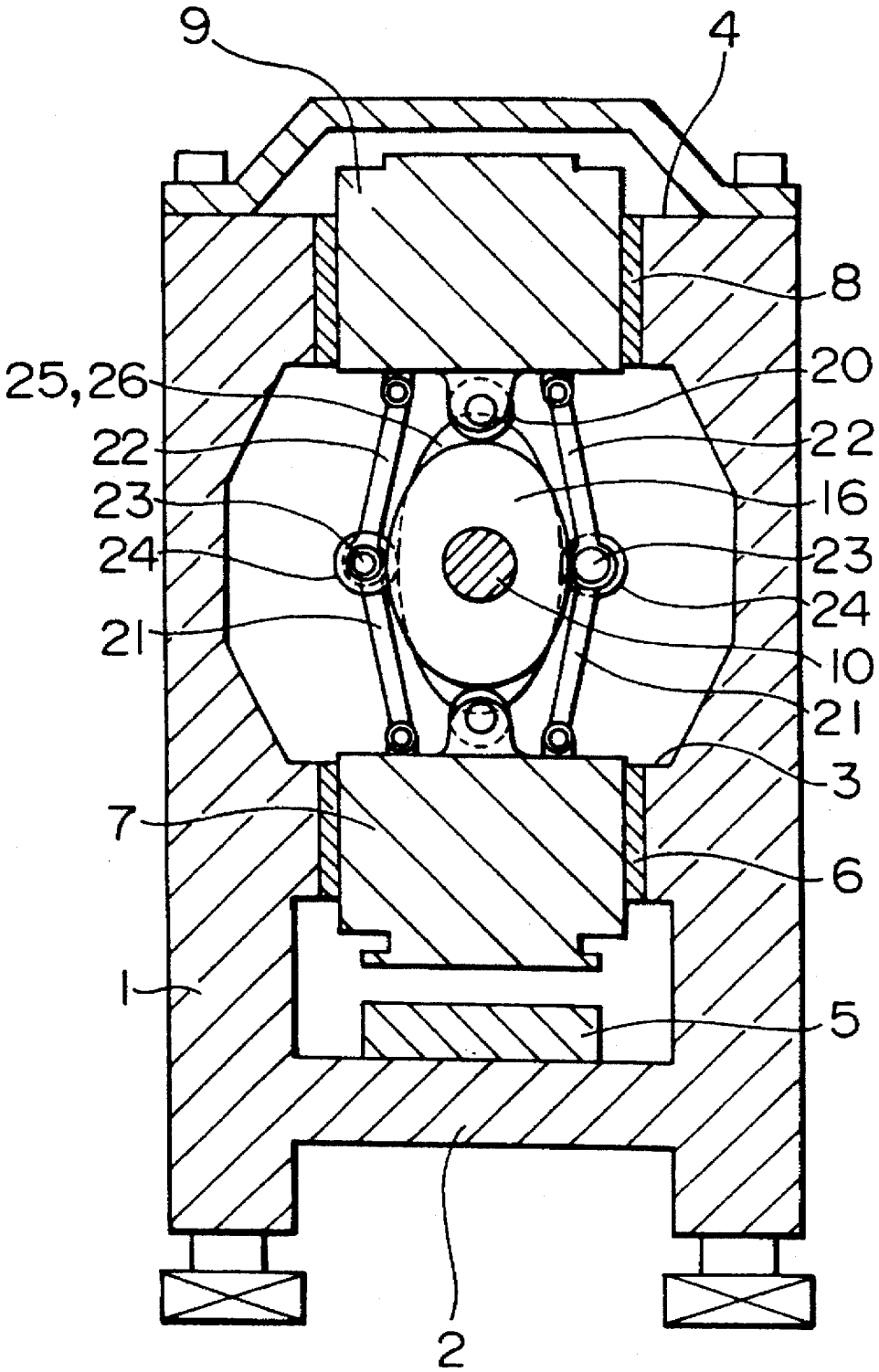
FIG. 1 is a schematic, cross-sectional view of one preferred embodiment of a mechanical pressing machine of the present invention as viewed from a front side thereof.
Figure 2:
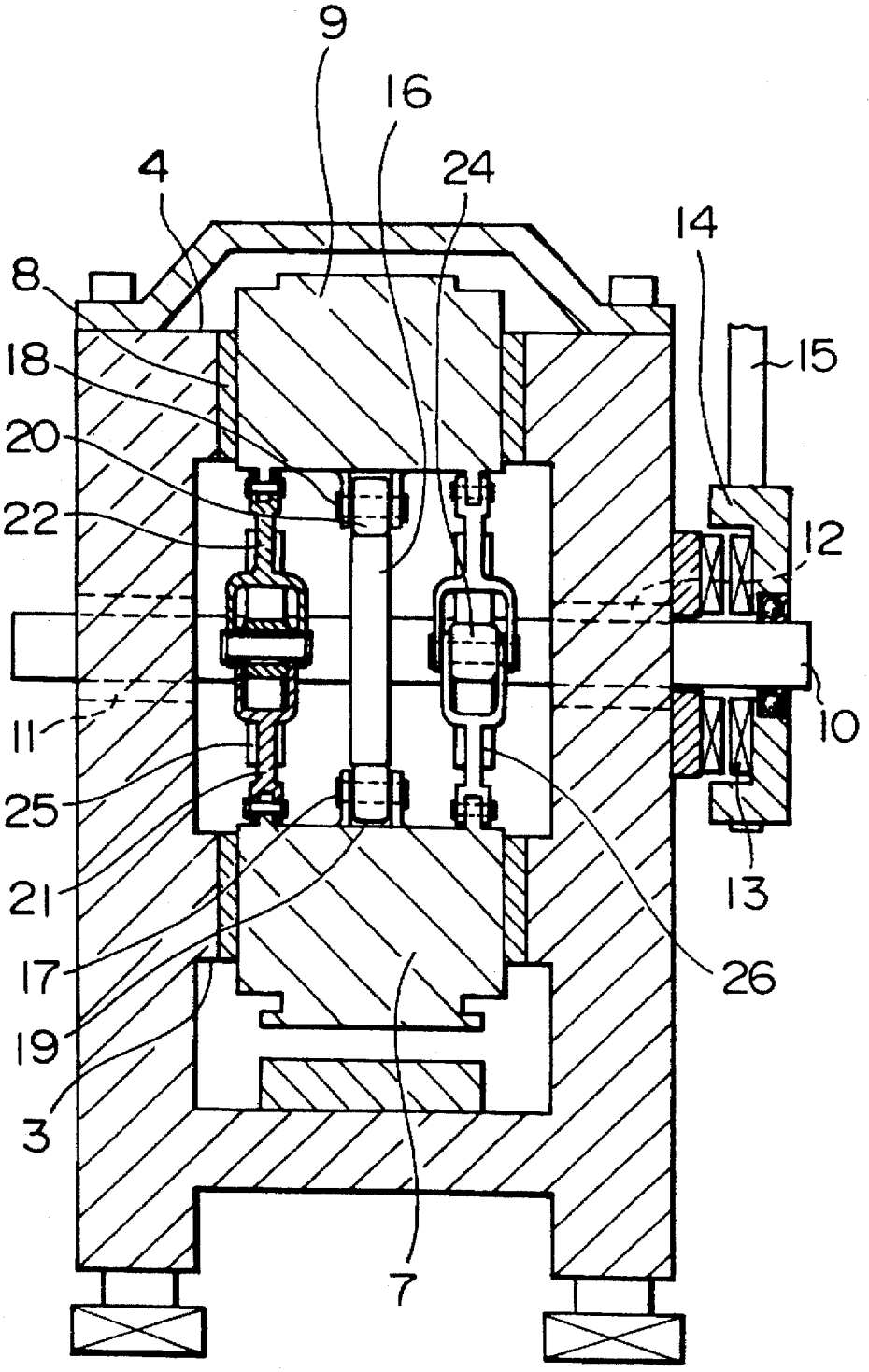
FIG. 2 is a schematic, cross-sectional view of the mechanical pressing machine as viewed from a side thereof.

FIG. 1 is a schematic, cross-sectional view of a preferred embodiment of a mechanical pressing machine of the present invention as viewed from a front side thereof, and FIG. 2 is a schematic, cross-sectional view of the mechanical pressing machine as viewed from a side thereof. In FIG. 1, an upright-type frame 1 includes a lower support portion 2, an intermediate support portion 3, and an upper support portion 4. A bed 5 is mounted on the lower support portion 2 of the frame 1, and a slider. 7 is mounted on the intermediate support portion 3 through a slide guide 6 so as to slide in a vertical direction. A die of the press comprises a lower die mounted on an upper surface of the bed 5, and an upper die mounted on a lower surface of the slider 7. A dynamic balancer 9 equal in weight to the slider 7 is mounted on the upper support portion 4 through a slide guide 8 so as to slide in the vertical direction.

In FIG. 2, a cam shaft 10 extends horizontally through a space between the intermediate support portion 3 and the upper support portion 4 of the frame 1, and is rotatably supported by bearings 11 and 12. A flywheel 14 is fixedly secured to one end of the cam shaft 10 through a clutch/brake 13, and this flywheel 14 is driven by a motor (not shown) through a belt 15. A press cam 16 is fixedly mounted on a central portion of the cam shaft 10, and has at its periphery a cam surface which is in contact with cam followers 19 and 20 rotatably mounted through respective studs 17 and 18 on a central portion of the upper surface of the slider 7 and a central portion of the lower surface of the dynamic balancer 9, respectively.

In FIGS. 1 and 2, two pairs of right and left link mechanisms are provided between the upper surface of the slider 7 and the lower surface of the dynamic balancer 9, and are disposed generally around the press cam 16, the two pairs being disposed at the front side portion and the rear side portion of the frame 1, respectively. Each of the link mechanisms comprises a first link 21 pivotally connected at its one end to the upper surface of the slider 7, and a second link 22 pivotally connected at its one end to the lower surface of the dynamic balancer 9. A cam follower 24 is rotatably mounted on the other ends (each having a fork-like shape) of the first and second links 21 and 22 through a stud 23. A pair of dynamic balancer cams 25 and 26 are fixedly mounted on the cam shaft 10, and each of the dynamic balancer cams 25 and 26 has at its periphery a cam surface which is in contact with the cam followers 24 of the corresponding pair of right and left link mechanisms. The press cam 16, as well as the dynamic balancer cams 25 and 26, has an elliptical shape which is 180° symmetrical. The elliptical shape of the dynamic balancer cams 25 and 26 is longer than that of the press cam 16. These cams 16, 25 and 26 may have any other suitable shape than such an elliptical shape.

Figure 3:
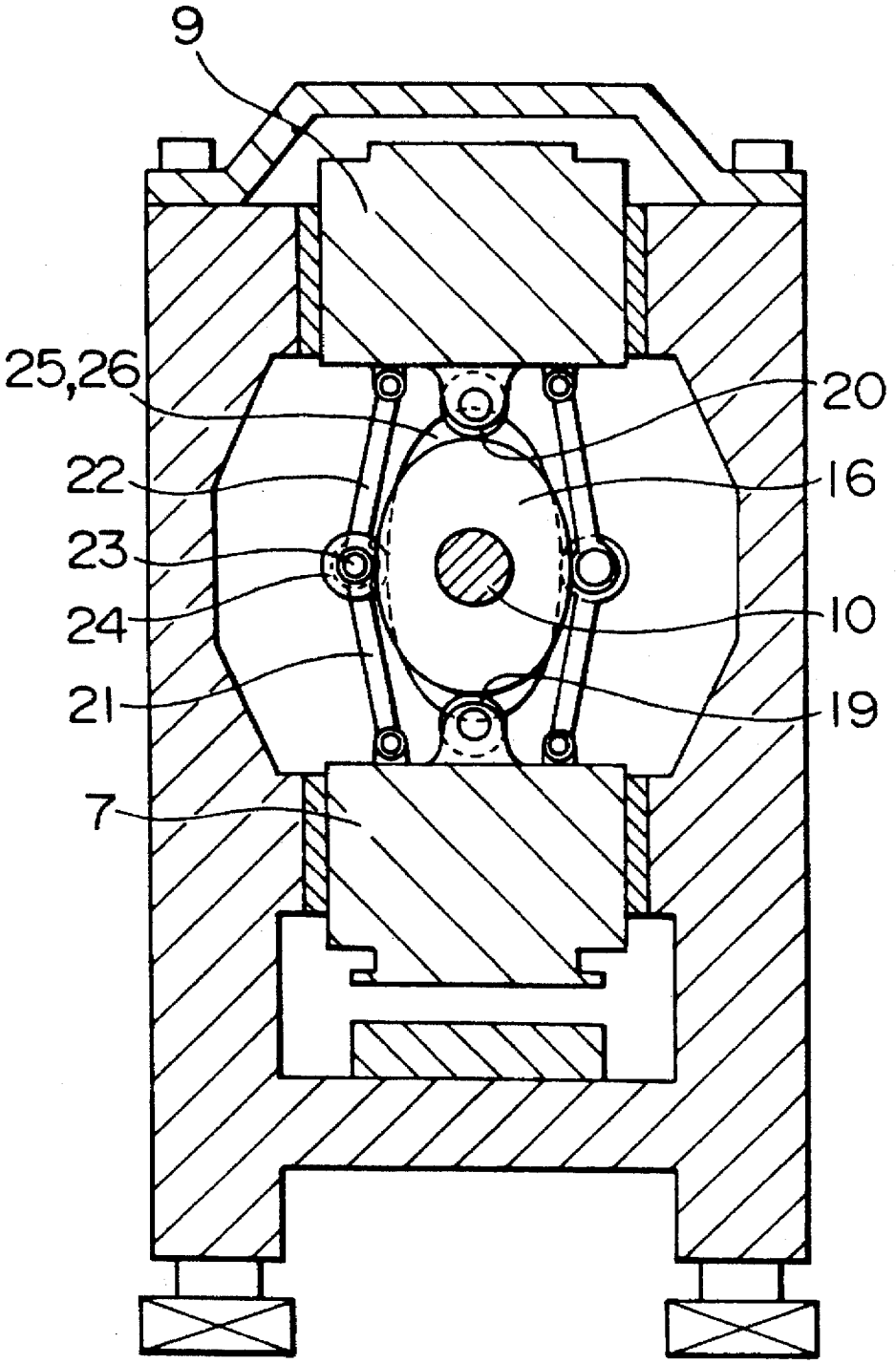
FIGS. 3 and 4 are views similar to FIG. 1, explanatory of the operation of the pressing machine.
Figure 4:
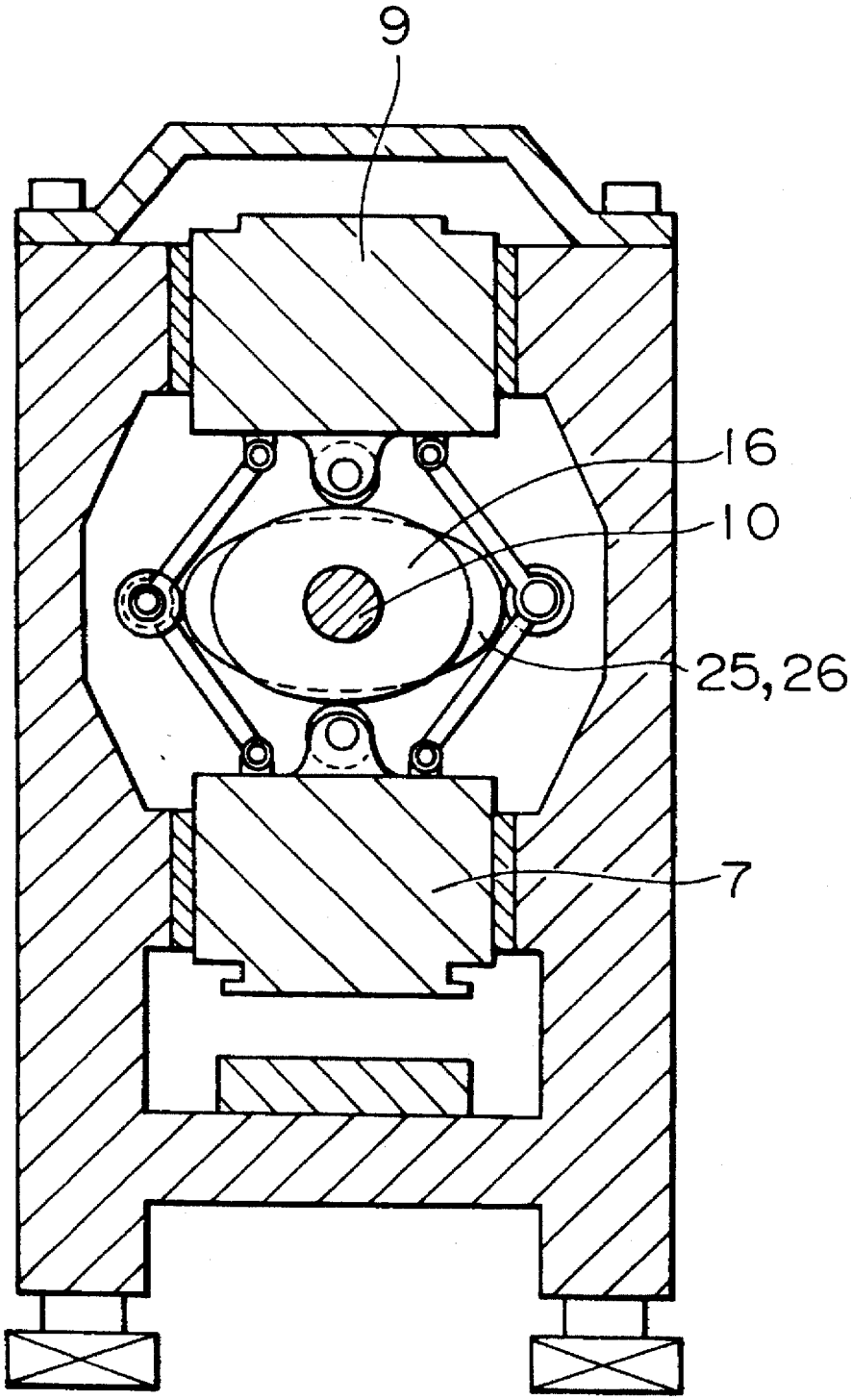

The operation of the above mechanical pressing machine will now be described. The motor (not shown) is rotated, and its rotational force is transmitted to the flywheel 14 through the belt 15, so that the press cam 16 and the dynamic balancer cams 25 and 26 are rotated through the cam shaft 10. The slider 7 and the dynamic balancer 9 are connected together by the two pairs of link mechanisms each comprising the first and second links 21 and 22, and are held or constrained in contact with the peripheral surface of the press cam 16 through the respective cam followers 19 and 20. Therefore, when the dynamic balancer cams 25 and 26 rotate from the respective positions shown in FIG. 3, each pair of right and left link mechanisms are expanded or urged away from each other through the cam followers 24 to move the slider 7 and the dynamic balancer 9 toward each other. This movement of the slider 7 and the dynamic balancer 9 is restrained by contact of the peripheral surface of the press cam 16 with the cam followers 19 and 20, so that a motion, controlled by the cam surface of the press cam 16, is imparted to the slider 7 and the dynamic balancer 9. As a result, the inertia force, produced in the ascending slider 7, is canceled by the oppositely-directed inertia force produced in the descending dynamic balancer 9 (which is equal in weight to the slider 7), and therefore the dynamic precision can be maintained regardless of a change in speed. When the cam shaft 10 rotates 90° from the position of FIG. 3 where the slider 7 is in its lower dead center, the slider 7 is brought into its upper dead center as shown in FIG. 4. When the cam shaft 10 further rotates 90° (that is, 180° from the initial position), the slider 7 is again brought into its lower dead center as shown in FIG. 3, thus completing one stroke. Therefore, the slider 7 effects two strokes per revolution of the cam shaft 10.

Figure 5B:
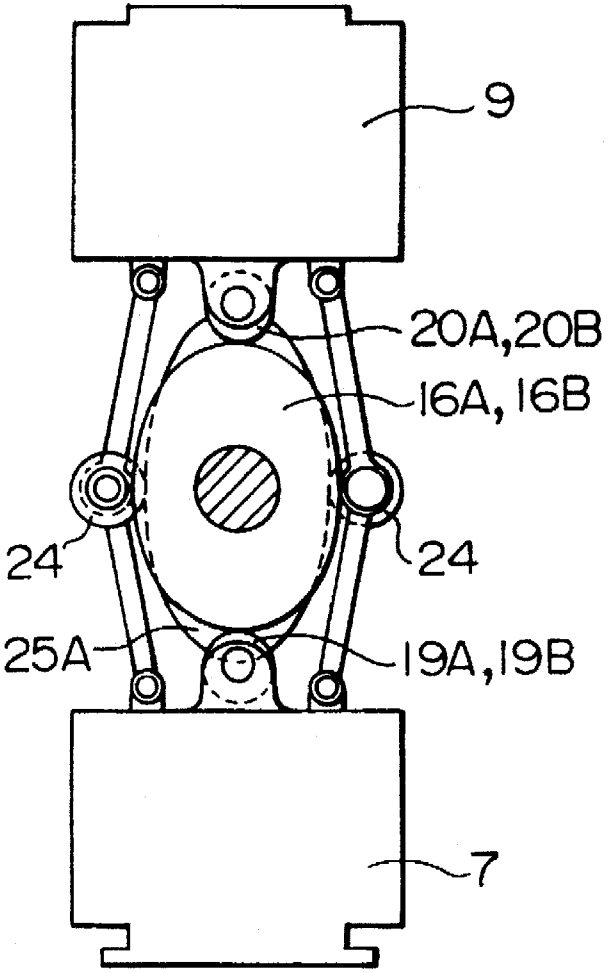
FIG. 5B is a schematic, cross-sectional view of the pressing machine of FIG. 5A as viewed from a front side thereof.
Figure 5A:
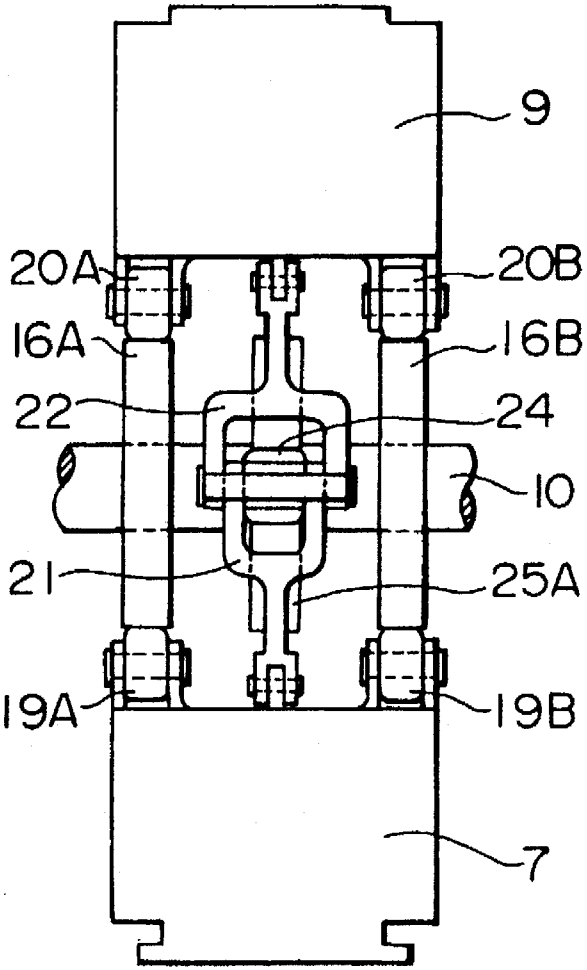
FIG. 5A is a schematic, cross-sectional view of another embodiment of a mechanical pressing machine of the invention as viewed from a side thereof.
Figure 6:
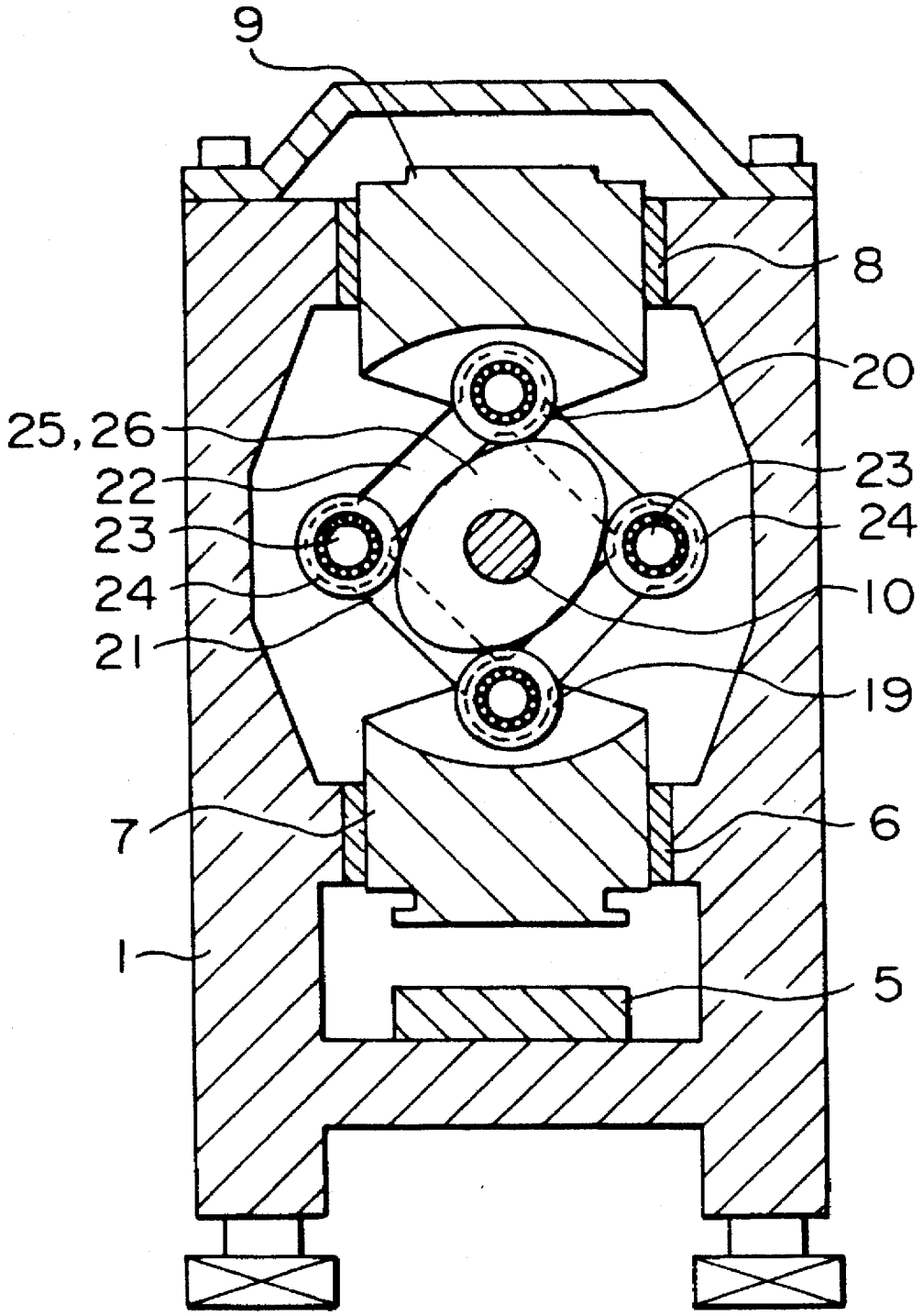
FIG. 6 is a schematic, cross-sectional view of a further embodiment of a mechanical pressing machine of the invention as viewed from a front side thereof.
Figure 7:
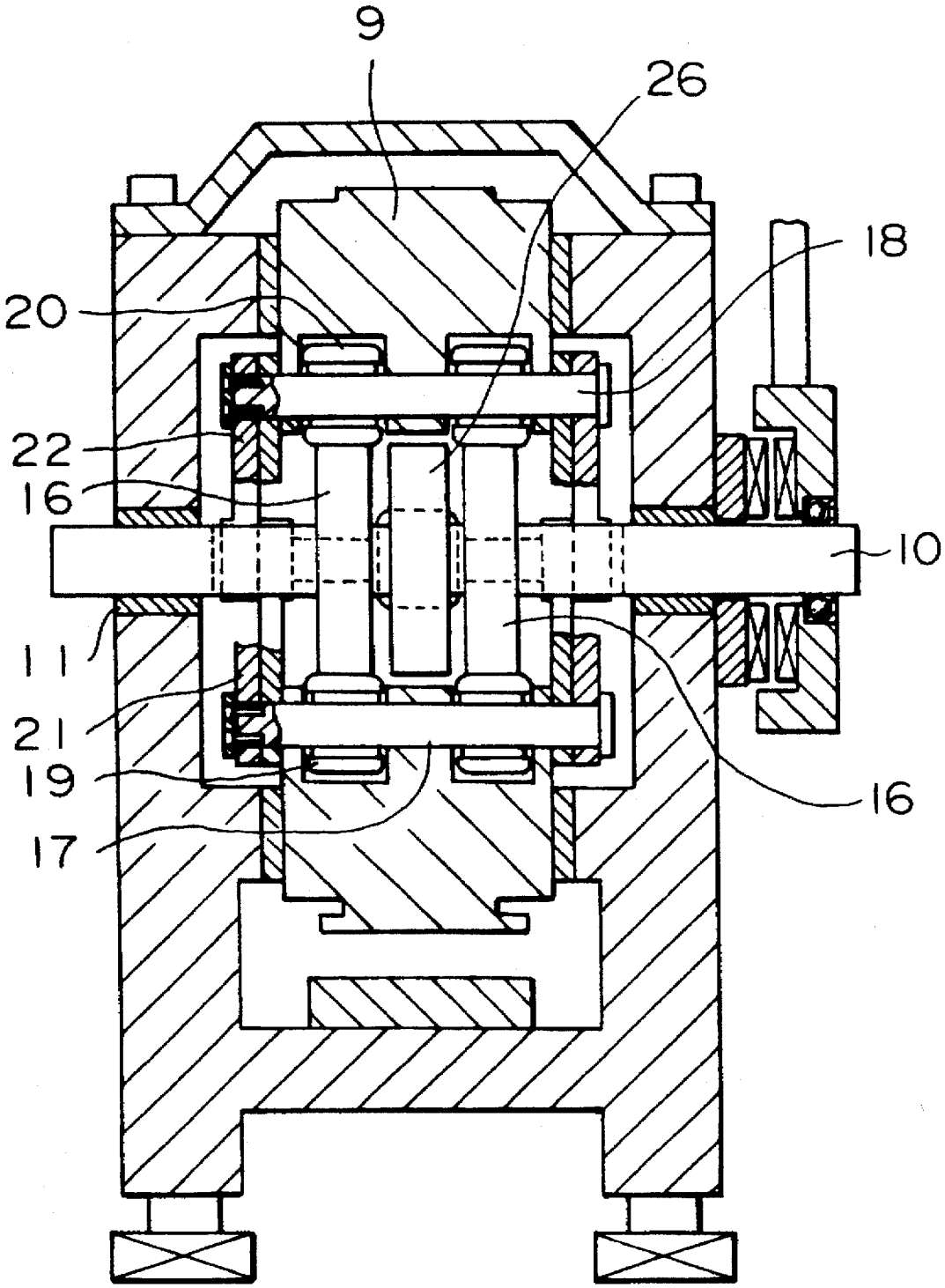
FIG. 7 is a schematic, cross-sectional view of the pressing machine of FIG. 6 as viewed from a side thereof.
Figure 8:
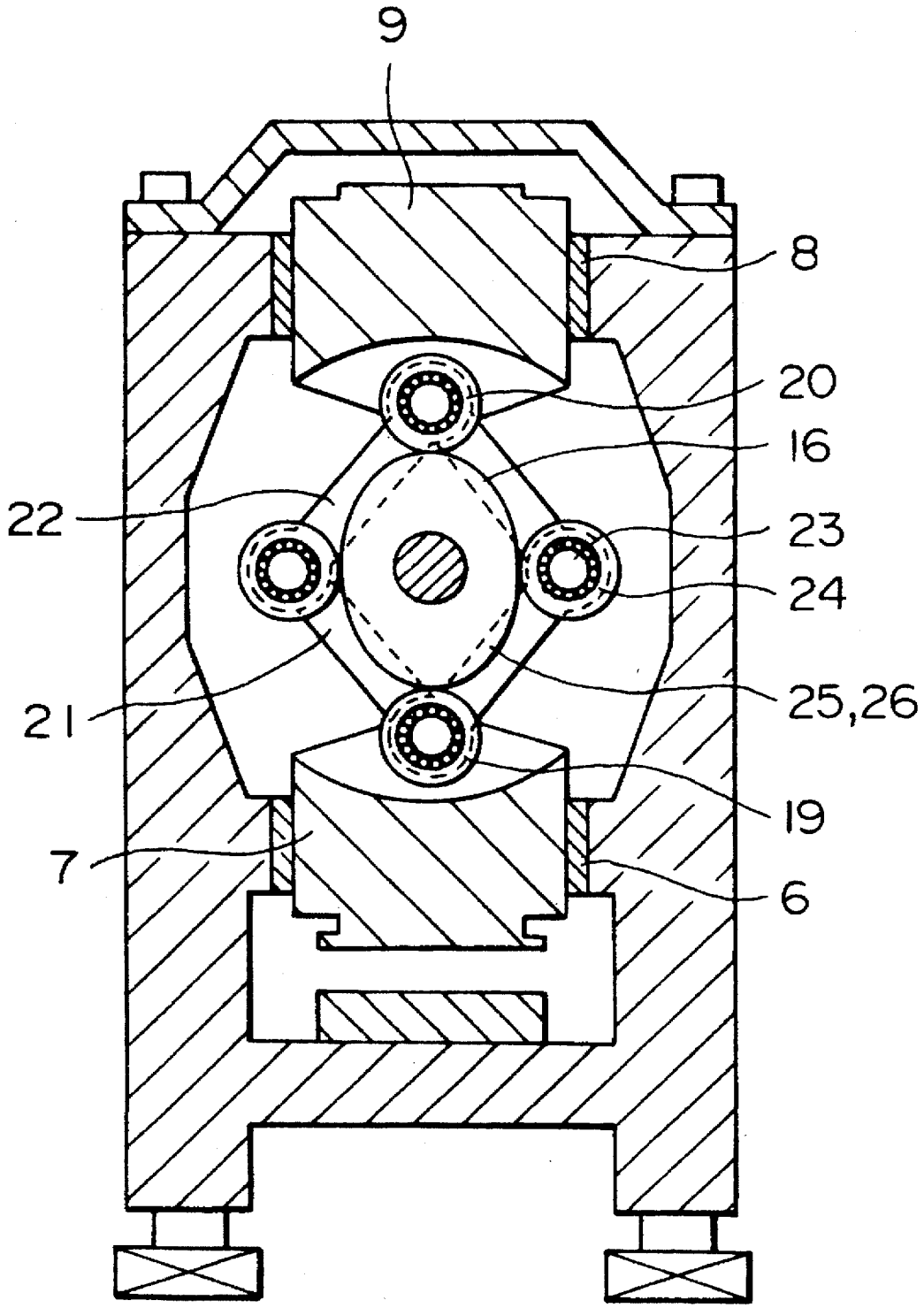
FIGS. 8 and 9 are views similar to FIG. 6, explanatory of the operation of the pressing machine of FIG. 6.
Figure 9:
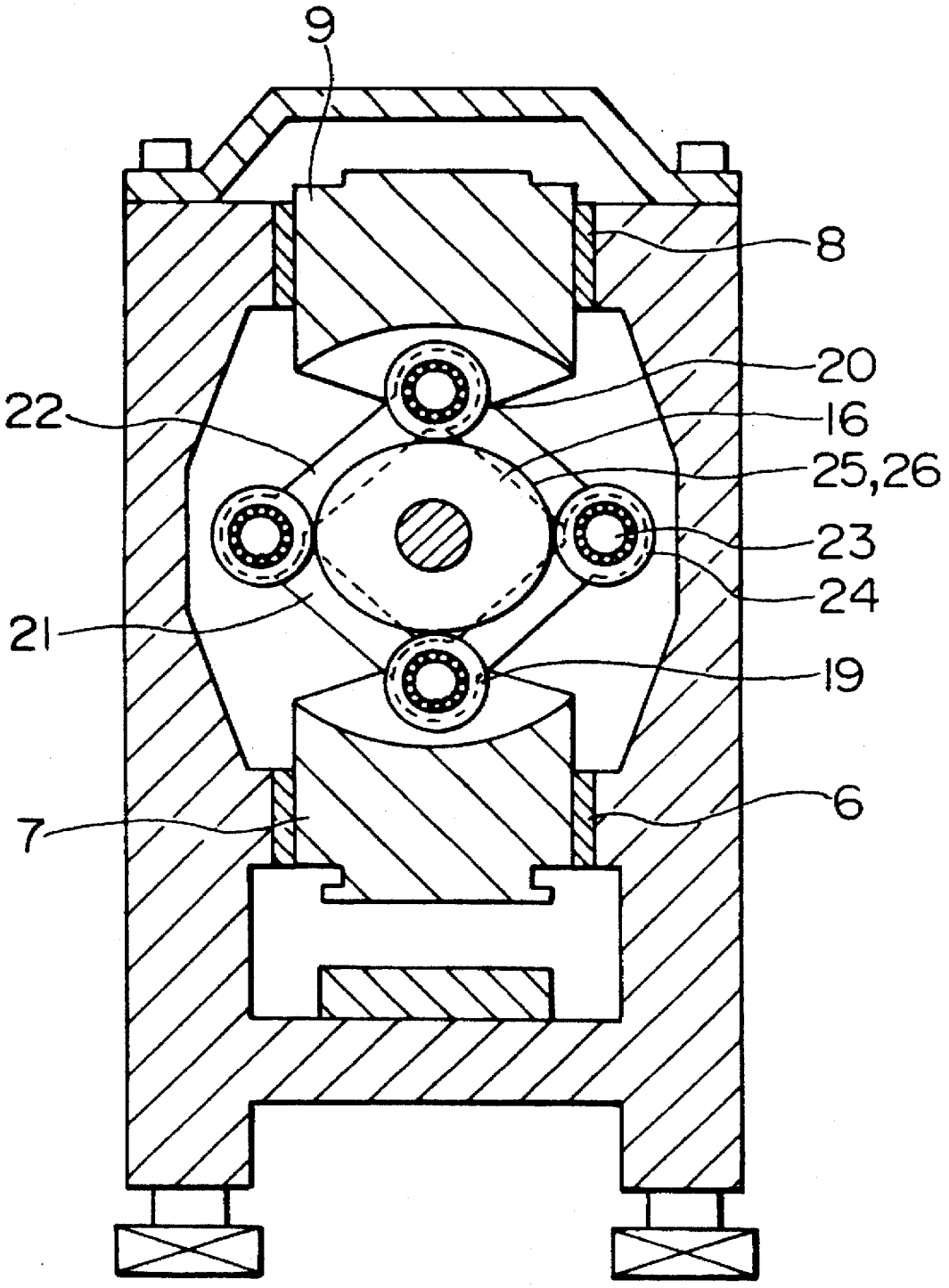

Although this embodiment is directed to the single-point press comprising the single press cam 16 and the two dynamic balancer cams 25 and 26, it may be modified into a two-point press as shown in FIGS. 5A and 5B, in which two press cams 16A and 16B and one dynamic balancer cam 25A are fixedly mounted on the cam shaft 10. In this case, four cam followers 19A, 19B, 20A and 20B are needed for the two press cams 16A and 16B, and only one pair of right and left link mechanisms are required for the dynamic balancer cam 25A.

As described above, in the above embodiment, thanks to the provision of the press cam 16 and the dynamic balancer cams 25 and 26 which are different in shape from the press cam 16, the upward and downward movement of the slider 7 can be perfectly controlled, and besides the vertically-opposite motion can be imparted to the dynamic balancer 9 having the same load as that of the slider 7. Therefore, with respect to an unbalanced inertia force produced in the slider 7, a similar inertia force, produced by movement of the dynamic balancer 9 in the opposite direction, is imparted to the slider 7 through the link mechanisms, thereby canceling this unbalanced inertia force. As a result, deflection of the whole of the press is reduced, so that the dynamic precision can be enhanced. Each of the cam followers 24, interconnecting the first and second links 21 and 22 of a respective one of the link mechanisms interconnecting the slider 7 and the dynamic balancer 9, is not supported by the frame 1 and other members, and is controlled in movement only by the dynamic balancer cam 25, 26 in a free condition. Therefore, the transmission efficiency is high, and the high-speed operation can be suitably carried out. And besides, since the slider 7 is driven by the cam, the timings of the ascending stroke and descending stroke of the slider, as well as the motion curve thereof, can be freely designed, and for example, the timing of the upper dead center or the timing of the lower dead center can be determined to be earlier.

FIGS. 6 to 9 show another embodiment of a mechanical pressing machine of the invention, and correspond to FIGS. 1 to 4, respectively. This embodiment of FIGS. 6 to 9 differs from the embodiment of FIGS. 1 to 4 (described above in detail) in that that portion where one end of each of first and second links 21 and 22 is pivotally connected is different.

Those different portions will now be described in detail.

In the embodiment of FIGS. 1 to 4, the one end of each first link 21 is pivotally connected to the upper surface of the slider 7, and the one end of each second link 22 is pivotally connected to the lower surface of the dynamic balancer 9. In the embodiment of FIGS. 6 to 9, the one end of each first link 21 is mounted on a stud 17 (on which cam followers 19, mounted on an upper surface of a slider 7, is mounted) in coaxial relation thereto, and the one end of each second link 22 is mounted on a stud 18 (on which cam followers 20, mounted on a lower surface of a dynamic balancer cam 9, is mounted) in coaxial relation thereto.

With this construction, this embodiment has the following advantages:

The number of the component parts is smaller, and the overall construction of the press is simple.

The slider and the dynamic balancer have such shapes that they can be easily worked or machined, and the required strength of each link support portion can be easily secured.

The link support positions in this embodiment of FIGS. 6 to 9 are thus different from those in the embodiment of FIGS. 1 to 4, and more specifically the first links are connected to the common shaft on the slider whereas the second links are connected to the common shaft on the dynamic balancer (The two common shafts are disposed in a centered manner), and therefore each link can be made the longest, so that the longest stroke can be obtained among those mechanisms employing such linkage arrangement.

Figure 10:
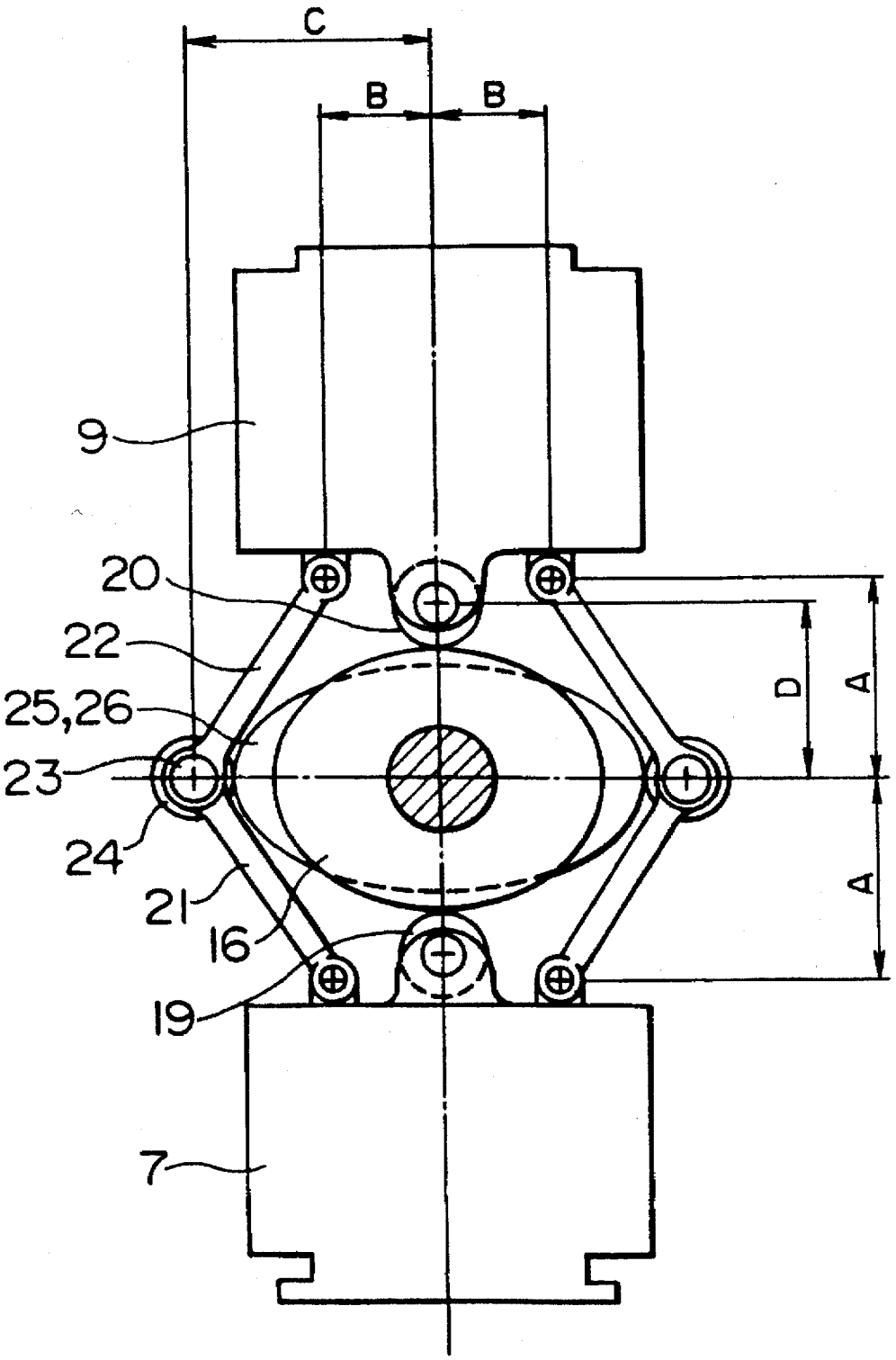
FIG. 10 is a schematic, cross-sectional view of a still further embodiment of a mechanical pressing machine of the invention as viewed from a front side thereof.

FIG. 10 shows a further embodiment of a mechanical pressing machine of the invention, and is a view explanatory of suitable conditions with respect to the connection of first links 21 to an upper surface of a slider 7 as well as the connection of second links 22 to a lower surface of a dynamic balancer 9.

In the mechanical pressing machine of this embodiment, preferably, the pair of right and left link mechanisms each comprising the first link 21 and the second link are mounted in the following manner:

(1) The distance A between the axis of pivotal movement of one end of the first link 21 (connected to the upper surface of the slider 7) and the center (axis) of the cam shaft 10 is equal to the distance A between the axis of pivotal movement of one end of the second link 22 (connected to the lower surface of the dynamic balancer 9) and the center (axis) of the cam shaft 10.

(2) The distance B between the center (axis) of the cam shaft 10 and the axis of pivotal movement of the one end of the right second link 22 (connected to the dynamic balancer 9) is equal to the distance B between the center (axis) of the cam shaft 10 and the axis of pivotal movement of the one end of the left second link 22 (connected to the dynamic balancer 9).

(3) As the distance between the upper and lower cam followers 20 and 19 increases, the distance between right and left cam followers 24 decreases, and in contrast, as the distance between the upper and lower cam followers 20 and 19 decreases, the distance between the right and left cam followers 24 increases. More specifically, if the distance between the center (axis) of the cam shaft 10 and the center (axis) of each of the right and left cam followers 24 is represented by C, the distance C is always larger than the distance B.

In the embodiment of FIGS. 6 to 9, if the distance between the center of the cam shaft 10 and the center of the stud 23 is represented by D, the distance A is equal to the distance D, and the distance B is zero (0).

As described in the above embodiment, there is provided the dynamic balancer which moves in a direction opposite to the direction of movement of the slider when the slider moves, and therefore an unbalanced inertia force, produced during the reciprocal movement of the slider, is canceled, and deflection of the whole of the pressing machine is reduced, thereby enhancing the dynamic precision, and vibrations and noises are reduced. And besides, the pressing machines of the invention are simpler in construction, and achieve higher precision as compared with the above earlier-proposed pressing machines, and the slider and the dynamic balancer are moved simultaneously not by sliding contact but by rolling contact between the cams and the cam followers, and therefore the transmission efficiency is enhanced, and the high-speed operation can be suitably carried out.

What is claimed is:

1. A mechanical pressing machine comprising:

a slider supported on a lower portion of a frame for sliding movement in a vertical direction, said slider carrying an upper press die at its lower surface;

a dynamic balancer supported on an upper portion of said frame for sliding movement in the vertical direction, said dynamic balancer being equal in weight to said slider;

a cam shaft rotatably supported on said frame, and extending in a horizontal direction, said cam shaft being connected at one end thereof to rotation transmission means;

at least one press cam fixedly mounted on said cam shaft for rotation therewith, said press cam having a cam surface in contact with cam followers mounted respectively on an upper surface of said slider and a lower surface of said dynamic balancer;

at least one pair of link mechanisms provided on opposite sides of said press cam, respectively, each of said link mechanisms comprising a pair of first and second links of the same length which are pivotally connected at one ends thereof to the upper surface of said slider and the lower surface of said dynamic balancer, respectively, and are pivotally connected together at the other ends thereof; and at least one dynamic balancer cam fixedly mounted on said cam shaft for rotation therewith, said dynamic balancer cam having a cam surface in contact with cam followers each of which is mounted on the interconnected other ends of said first and second links of a respective one of said link mechanisms.

2. A pressing machine according to claim 1, in which said press cam and said dynamic balancer cam have different shapes from each other, and the shape of each of said two cams is 180° symmetrical.

3. A pressing machine according to claim 2, in which there are provided one said press cam and two said dynamic balancer cams.

4. A pressing machine according to claim 2, in which there are provided two said press cams and one said dynamic balancer cam.

5. A mechanical pressing machine comprising:

a slider supported on a lower portion of a frame for sliding movement in a vertical direction, said slider carrying an upper press die at its lower surface;

a dynamic balancer supported on an upper portion of said frame for sliding movement in the vertical direction, said dynamic balancer being equal in weight to said slider;

a cam shaft rotatably supported on said frame, and extending in a horizontal direction, said cam shaft being connected at one end thereof to rotation transmission means;

at least one press cam fixedly mounted on said cam shaft for rotation therewith, said press cam having a cam surface in contact with cam followers mounted respectively on an upper surface of said slider and a lower surface of said dynamic balancer;

at least one pair of link mechanisms provided on opposite sides of said press cam, respectively, each of said link mechanisms comprising a pair of first and second links of the same length one ends of which are pivotally connected respectively in coaxial relation to said cam followers mounted respectively on the upper surface of said slider and the lower surface of said dynamic balancer, and the other ends of said pair of first and second links being pivotally connected together; and at least one dynamic balancer cam fixedly mounted on said cam shaft for rotation therewith, said dynamic balancer cam having a cam surface in contact with cam followers each of which is mounted on the interconnected other ends of said first and second links of a respective one of said link mechanisms.

6. A pressing machine according to claim 5, in which said press cam and said dynamic balancer cam have different shapes from each other, and the shape of each of said two cams is 180° symmetrical.

7. A pressing machine according to claim 6, in which there are provided one said press cam and two said dynamic balancer cams.

8. A pressing machine according to claim 6, in which there are provided two said press cams and one said dynamic balancer cam.

* * * * *

UNITED STATES PATENT AND TRADEMARK OFFICE

CERTIFICATE OF CORRECTION

PATENT NO. : 5,687,645

DATED : November 18, 1997

INVENTOR(S) : Heizaburo Kato

It is certified that error appears in the above-identified patent and that said Letters Patent is hereby corrected as shown below:

Col. 1, line 52, insert after "." --The Japanese patent application corresponding to Serial No. 08/293,752 was published in Japan on March 7, 1995 into Laid-Open Publication No. 60497/1995 and the Japanese patent application corresponding to Serial No. 08/293,815 was published in Japan on March 7, 1995 into Laid Open Publication No. 60499/1995. The U.S. Application Serial No. 08/293,752 has been abandoned in favor of continuation in part application Serial No. 08/610,452 filed March 4, 1996. The U.S. Application Serial No. 08/293,815 has issued into U.S. Patent No. 5,467,706 on November 21, 1995.--

Col. 3, line 15, delete "."

Signed and Sealed this

Twenty-fourth Day of February, 1998

*Attest:*

*Attesting Officer*

Bruce Lehman

BRUCE LEHMAN

*Commissioner of Patents and Trademarks*